United States Patent [19]

Anselmo

[11] Patent Number: 4,577,585

[45] Date of Patent: Mar. 25, 1986

[54] METHOD AND APPARATUS FOR MAKING A COLOR BLENDED WALL COVERING

[76] Inventor: Anthony G. Anselmo, 819 - 19th St., Santa Monica, Calif. 90403

[21] Appl. No.: 602,765

[22] Filed: Apr. 23, 1984

[51] Int. Cl.[4] ..... B05B 7/06; B05B 3/00; B05B 1/28; B05C 5/00

[52] U.S. Cl. ..... 118/50; 118/314; 118/315; 118/323; 118/326; 427/288; 427/289; 427/296; 427/424

[58] Field of Search ..... 118/313-316, 118/323-325, 50; 427/262, 265, 286, 288, 424, 426, 289, 296, 374.1, 398.2

[56] References Cited

U.S. PATENT DOCUMENTS 3,462,290 8/1969 Kresse et al. ..... 427/398.2 X 4,141,231 2/1979 Kudlich ..... 118/314 X 4,347,275 8/1982 Kajikawa et al. ..... 427/289 X

*Primary Examiner*—Michael R. Lusignan

*Attorney, Agent, or Firm*—Jack C. Munro

[57] ABSTRACT

A method of forming a wall covering which forms a plurality of horizontal colored sections wherein the colored sections are smoothly blended into each other forming no visual break from one color to the next. The machine is utilized wherein the uncolored ground is moved until a given length of the ground is located within a paint spray chamber. The ground is then fixed in position and a paint nozzle assembly moved laterally across the ground producing the desired colored pattern on the ground. The ground is then moved from the paint spray chamber into a drying chamber and from the drying chamber onto a collecting roll.

5 Claims, 3 Drawing Figures

METHOD AND APPARATUS FOR MAKING A COLOR BLENDED WALL COVERING

BACKGROUND OF THE INVENTION

The field of this invention relates to manufacturing of wallpaper and more particularly to a new and novel design of wallpaper wherein a different color pattern is produced in a vertical direction with the different colors blending into one another forming no visually observable break from one color to the next.

It is common to apply colors to a wall within an office or residence. Common forms of wall coverings are paint and wallpaper. Wallpaper has been manufactured in the past in various colors and in various patterns. Wallpaper is normally sold in certain widths, such as twenty-seven and fifty-four inches, and also in a certain length, such as sixteen to fifty feet in a roll.

The conventional method of manufacturing the wallpaper is to pass a strip of the basic paper (vinyl or fabric), known as the ground, through a machine which produces the color, pattern or design that the machine is preset to form. The design can be printed on the ground and in some cases it is painted on the ground.

In painting of a colored pattern on the ground it is common to orient a series of paint spray nozzles directly above the ground in a preset, spaced apart manner. As the ground is moved through the machine, the nozzles are activated which then causes the desired painting pattern to be produced on the ground. Any colored pattern which is to be produced is limited by the movement of the ground through the machine. In other words, if it is desired to produce a striped pattern, the striped pattern is usually limited to vertical stripes since the spray nozzles are fixed and the relative movement between the nozzle and the ground is in alignment with the direction of movement of the ground through the machine. This happens to be parallel to the elongated axis of the ground which will result in a vertical stripe when the resulting wallpaper is placed on the wall.

In the past, it has been known to make an effort to have different colors of wallpaper blend into each other, though creating different regions of color, the colors overlap and blend or shade into each other creating a variegated, cloud effect. Again, because of the inherent moving of the ground through the machine, the different colors are limited to generally oriented stripes which do not have visually observable, well-defined edges separating one color from the other.

Blending of colors to create a smooth transition from one color to another is desirable and tend to create a very soothing effect for many people. However, the locating of generally vertical stripes can be very unsettling. Therefore, the smooth peaceful appearance obtained in the blending of the different colors is lost because of the creation of the vertical type stripes.

In any room it has been found that if colors were blended so that the portion of the wall directly adjacent the ceiling was one color, and as you went lower on the wall blended into a second color, and as you still went lower on the wall, possibly blended into a third or more colors, that this type of color pattern has a general peaceful soothing affect. Also, this type of color arrangement could work very well with accessories in a room and also with the floor covering. However, prior to the present invention, there was no way to purchase a wall covering which could achieve this end. The only way that a room could be colored in this manner would be by hand painting the room. This is inherently very expensive due to the labor involved, therefore, not available to the general public.

SUMMARY OF THE INVENTION

The machine of the present invention is for the purpose of manufacturing wallpaper wherein the manufactured strips of the wallpaper, such as nine feet in length, vary in color (or color intensity) from the top of the strip to the bottom of the strip and do so in a blended smooth manner. As the different strips of the wallpaper are placed on the wall in a side-by-side manner, this color pattern continues to be maintained. The machine of the present invention includes a supply roll section. An initial stock of ground, which forms the base of the wallpaper, is mounted in the supply roll section with the free end of the ground being fed into a paint spray chamber within the machine. This paint spray chamber includes an elongated bed which has a series of holes through which a vacuum can be applied. The ground is laid onto the bed. Located over the ground is a nozzle assembly comprising a plurality of separate nozzles. The nozzles are designed to move transversely across the entire width of the ground. Each nozzle is preset to spray a particular color of paint onto the ground in a particular quantity. The ground is moved into the paint spray chamber and is fixed into position utilizing a vacuum being pulled through the bed within the paint spray chamber. The use of the vacuum keeps the ground from even slightly moving which could cause undesirable sprayed areas on the resulting formed wallpaper. The nozzles are programmed to move across the ground spraying the paint in the desired quantity for the desired length of time. The vacuum is now released and the ground that has been painted is moved out of the paint spray chamber with a new section of ground now being located on the vacuum bed. Within the paint spray chamber the painting process is repeated. The painted portion of the ground is now moved into a drying chamber in which, after the painted ground becomes completely dry, it is moved exteriorly of the drying chamber. The painted ground comes into contact with a slitter which cuts the ground into a plurality of widths which will result in the desired width for each roll of wallpaper. The now slit ground is then wound upon an appropriate collecting roll (or rolls) to be subsequently removed and then utilized as a wall covering or as a ground for subsequent over printing. Both the collecting roll and the supply roll normally will be driven at a constant speed even though the ground will be stopped within the paint spray chamber during the paint applying time.

DETAILED DESCRIPTION OF THE SHOWN EMBODIMENT

Figure 1:
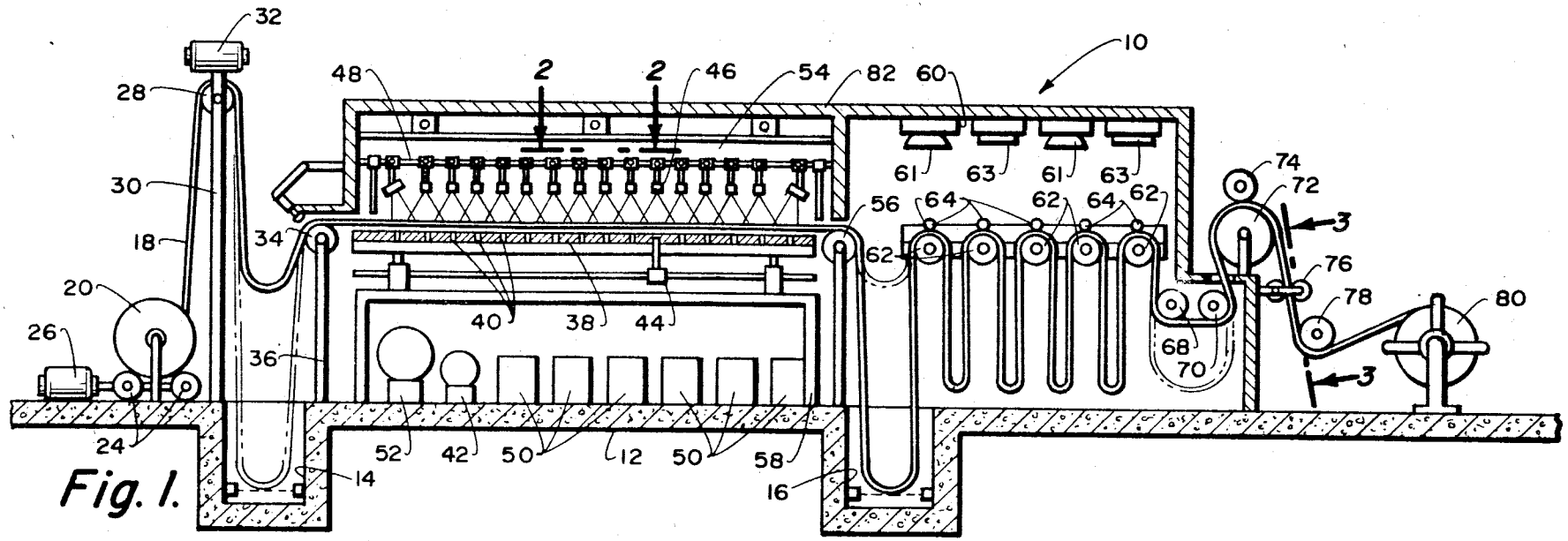
FIG. 1 is a diagrammatic side elevational view of a typical illustrative form of the machine of the present invention explaining generally how the machine will be constructed to achieve the manufacture of the wall covering of the present invention.
Figure 2:
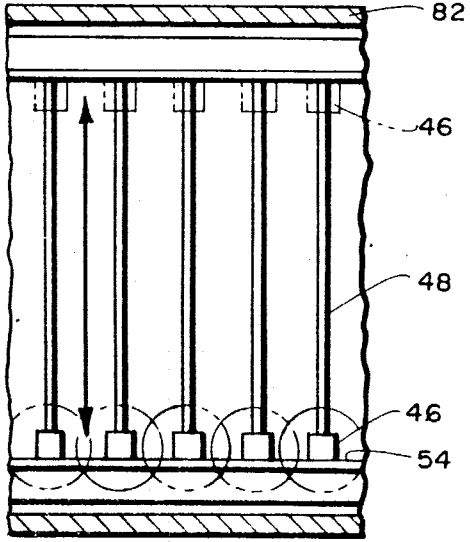
FIG. 2 is a top plan view of a portion of the paint spray chamber incorporated within the machine of this invention taken along line 2—2 of FIG. 1.
Figure 3:
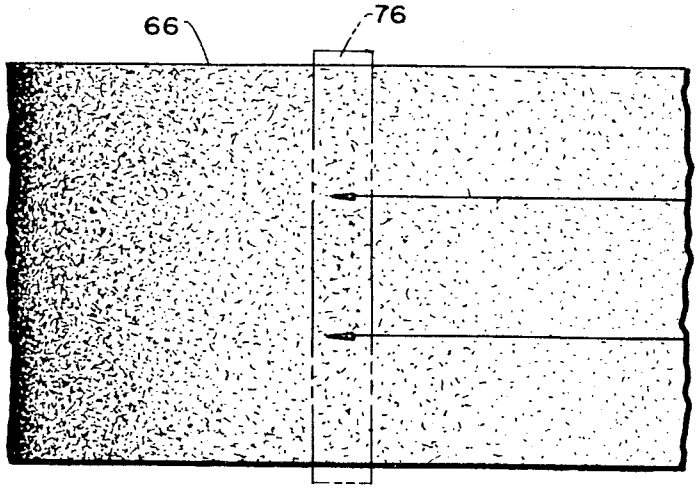
FIG. 3 is a view through a portion of the wallpaper which has been manufactured by the machine of the present invention taken along line 3—3 of FIG. 1.

Referring particularly to the drawing there is shown the machine 10 of this invention which is shown mounted on a supportive surface such as a floor 12 of a building. Floor 12 includes pits 14 and 16 which will be explained further on in this specification.

The sheet material ground 18 is wound on a supply roll 20. Normal size of the supply roll 20 would be sixty inches wide and thirty-six inches in diameter. Supply roll 20 rests on rollers 22 and 24. Rollers 22 and 24 are to be rotatively driven by means of a variable speed motor 26. The speed of the motor 26 is to be preprogrammed so that the ground 18 from the supply roll 20 is to be unwound at a constant rate.

The ground 18 is conducted over a drive roll 28 which is mounted at the top of a supporting post assembly 30. The drive 28 is rotatively driven by means of a motor 32. The drive roll 28 is driven constantly to unwind the same amount of the ground 18 as is unwound from the supply roll 20.

The ground 18 is then conducted onto a roll 34 which is mounted at the top of supporting post assembly 36. The ground is then conducted from roller 34 across a planar bed 38. The bed 38 is fixedly supported with respect to the housing of the machine 10 by means which are not shown.

Within the bed 38 are formed a plurality of holes 40. Through the holes 40 is conducted a vacuum from a vacuum pump 42. A sensor 44 is mounted adjacent the bed in conjunction with the bed 38 and its function is to sense the length of the ground 18 as it is being moved across the bed 38. Once the desired length of ground 18 is located on top of the bed 38, the sensor then will cause the ground 18 to stop and then activate the vacuum pump 42 which causes a vacuum to be drawn to the holes 40 against the ground 18 and holds such tightly against the bed 38. This condition is maintained through the painting operation of that particular portion of the ground that is resting on top of the bed 38.

In order to achieve the painting of the ground 18, there are used a grouping of paint nozzles 46. The nozzles 46 are mounted on a bar assembly 48. Each of the nozzles 46 are to move in unison with each other from one lateral edge of the ground 18 to the opposite lateral edge of the ground 18. Paint is to be supplied from paint containers 50 by means of copressor 52 to each of the nozzles 46.

Certain nozzles 46 will receive certain colors of paint while other nozzles 46 will receive different colors of paint. Also, each of the nozzles 46 will be adjusted as to the amount of paint that is sprayed. Normally, the nozzles 46 are to make a single pass across the ground 18. After painting of a portion of the ground 18, that portion is moved from the bed 38 with a new section of ground 18 being located on the bed 38. The nozzles 46 will then be conducted in the reverse direction making a similar painting pass.

It is to be understood that the nozzles 46 in conjunction with the bed 38 form a paint spray chamber 54. The ground 18, after it has passed over the bed 38, is positioned on a roll 56. This roll 56 is mounted on the upper end of a supporting post assembly 58 which in turn is mounted on floor 12. The roll 56 is to be rotatively driven by means of a motor (not shown).

It may be found to be desirable to rotatively drive the roll 34 at the same rotational speed that roll 56 is driven. The ground 18 is conducted from the roll 56 into a drying chamber 60. Within the drying chamber are located a series of conveyer rollers 62. Associated with each conveyer roller 62 is a pinch roller 64. The now painted ground which, will now be referred to as wallpaper 66, is conducted over each of the conveyer rollers 62 and is pinched by each pinch roller 64. The function of the conveyer roller 62 is so as to have the painted wallpaper 66 assume an extended length in the drying chamber 60 so as to provide for adequate length of time to dry. The wallpaper is dried by heat lamps 61 and/or forced air heaters 63.

The now dried painted wallpaper 66 is conducted across rollers 68 and 67 onto a chiller roll 72. The function of the chiller roll 72 is to cool the heated wallpaper 66 as it comes from the drying chamber 60. Located on the exterior surface of the wallpaper 66 as it passes over the chiller roll 72 is a tension roller 74.

The painted wallpaper 66 is then conducted in conjunction with a slitter mechanism 76. The slitter mechanism 76 separates the sixty inch width of the wallpaper 66 into smaller widths such as three widths of twenty inches each.

From the slitter 76 the wallpaper 66 is conducted over a counting roller 78 and onto a collecting rewind roll assembly 80. After the entire length of the ground 18 which has been preloaded onto the supply roll 20 has been painted and rewound on collecting roll 80, the now painted, rolled up wallpaper 66 is removed from the collecting roll 80 and distributed in a desired manner. The rewind or collecting roll 80 is to be driven from a motor not shown at also a constant speed. The entire machine 10 is contained within a housing 82.

To summarize the operation of machine 10 of this invention, the ground 18 is being constantly fed toward the paint spray chamber 54. A section of the ground 18 is rapidly fed onto the bed 38 at which time the generated slack in the ground 18 is taken up with space for the slack being provided within the pit 14. The solid line position shown in FIG. 1 of the drawing shows the ground 18 having been just fed into the paint spray chamber 54 and now stopped. The vacuum is then applied to the bed 38 which causes the ground 18 to be securely held into position onto the bed 38. At this particular time the compressor 52 is activated causing paint to be supplied to the respective nozzles 46 with the nozzles 46 then being moved laterally across the ground 18 in a single pass.

After the painting operation, the portion of the painted ground 18 on the bed 38 is then moved out of the paint spray chamber 54 forming a section of slack which is to extend within the pit 16. During the painting operation of one portion of the ground, the supply roll 20 is continually being rotated which causes slack to again be created extending within the pit 14. Since the collecting roll 80 is also being constantly driven, the slack that has now been created within the pit 16 is being constantly taken up and conducted through the dryer chamber 60. At the time when the painting operation is ended of a portion of the ground within the paint spray chamber 54, the slack adjacent the dryer chamber 60 has been almost completely eliminated. At this particular time there is a substantial amount of slack of the ground 18 extending within the pit 14. Again, the painted section of the ground 38 is then moved to form slack that would extend within the pit 16 with the painted wallpaper 66 now being continued to move through the dryer chamber 60 to be hence cut by the slitter 66 and accumulated on the collecting roll 80.

It is anticipated that a typical painting cycle will actually be about ten seconds long. A typical length of the ground that is being painted on the bed 38 would be from eight to eighteen feet long.

What is claimed is:

1. A machine for applying a multiple colored pattern onto a ground or wall covering comprising:

a supply roll section for supplying a continuous strip of said ground, said ground having a width defined by a pair of spaced apart lateral parallel edges;

a paint spray chamber, said ground to be moved into and through said paint spray chamber along a lineal axis, a nozzle assembly mounted within said paint spray chamber, said nozzle assembly being adapted to spray paint, said nozzle assembly being movable in a direction transverse to said lineal axis so paint is applied to said ground across said ground, said movement of said nozzle assembly being continuous from one said lateral edge to the other said lateral edge, said nozzle assembly creating a smooth blend of colors on said ground with there being no visual break from one color to the next, said paint spray chamber including an elongated planar bed, said ground to be moved onto said bed and momentarily fixed in position by fixing means during which time painting of said ground is to occur;

a drying chamber, said ground being movable from said paint spray chamber into said drying chamber;

a collecting roll section for collecting the now painted and dried said ground;

first means for rotating of said supply roll section for continuously unwinding of said ground at a steady rate; and second means for continuously rotating of said collecting roll section at a steady rate causing winding of said ground onto a collecting roll.

2. The machine as defined in claim 1 wherein:

said nozzle assembly comprising a plurality of separate nozzles.

3. The machine as defined in claim 2 wherein:

said fixing means includes a vacuum being applied through said bed for tightly locating said ground into physical contact with said bed.

4. The machine as defined in claim 3 including:

chilling means located between said drying chamber and said collecting roll section, said ground to connect with said chilling means for decreasing the temperature of said ground prior to winding of said ground onto said collecting roll.

5. The machine as defined in claim 4 including:

slitting means located between said chilling means and said collecting roll section, said slitting means to cut said ground prior to being wound on said collecting roll.

* * * * *